US011136683B2

(12) United States Patent
Cerezo

(10) Patent No.: US 11,136,683 B2
(45) Date of Patent: Oct. 5, 2021

(54) CATHODE AND METHOD OF MANUFACTURING

(71) Applicants: Steelmore Holdings Pty Ltd., Queensland (AU); Glencore Technology Pty Ltd, Queensland (AU)

(72) Inventor: Jason Robert Cerezo, Queensland (AU)

(73) Assignee: Glencore Technology Pty Ltd., Brisbane (AU)

( * ) Notice: Subject to any disclaimer, the term of this patent is extended or adjusted under 35 U.S.C. 154(b) by 230 days.

(21) Appl. No.: 16/156,531

(22) Filed: Oct. 10, 2018

(65) Prior Publication Data

US 2019/0040539 A1 Feb. 7, 2019

Related U.S. Application Data

(62) Division of application No. 14/431,569, filed as application No. PCT/AU2013/001109 on Sep. 26, 2013, now abandoned.

(30) Foreign Application Priority Data

Sep. 26, 2012 (AU) ..... 2012904201

(51) Int. Cl.
*C25C 7/02* (2006.01)
*C25C 1/12* (2006.01)

(52) U.S. Cl.
CPC ..... *C25C 7/02* (2013.01); *C25C 1/12* (2013.01); *Y10T 29/49117* (2015.01)

(58) Field of Classification Search
CPC ..... H04W 72/0413; H04W 72/0446; H04L 1/0057; H04L 1/0064; H04L 1/0041; H04L 1/0061; H04L 1/0071; H04L 1/1812; H04L 1/0076; H03M 13/2966; H03M 13/1515; H03M 13/611; H03M 13/618; H03M 13/635; H04H 20/38
See application file for complete search history.

(56) References Cited

U.S. PATENT DOCUMENTS

| | | | |
|---|---|---|---|
| 4,269,687 | A | 5/1981 | Gilbert |
| 4,647,358 | A | 3/1987 | Bartsch et al. |
| 6,569,300 | B1 | 5/2003 | Assenmacher |
| 7,591,934 | B2 | 9/2009 | Mardsen et al. |
| 2004/0065721 | A1 | 4/2004 | Polvi |
| 2009/0050488 | A1 | 2/2009 | Jickiling et al. |
| 2009/0288856 | A1 | 11/2009 | Sandoval |

(Continued)

FOREIGN PATENT DOCUMENTS

| | | | |
|---|---|---|---|
| CA | 2489889 | A1 | 12/2003 |
| CN | 101851763 | A | 10/2010 |

(Continued)

OTHER PUBLICATIONS

International Search Report received in corresponding application No. PCT/AU2013/001109, dated Dec. 18, 2013, 5 pages.

(Continued)

*Primary Examiner* — John C Hong
(74) *Attorney, Agent, or Firm* — Blank Rome LLP

(57) ABSTRACT

A method is disclosed for manufacturing a cathode for electrolytic processes, the cathode comprising a conducting bar and a plate attached to the conducting bar, wherein the conducting bar has a conducting member attached thereto to increase the conductivity of the conducting bar.

7 Claims, 7 Drawing Sheets

(56) References Cited

U.S. PATENT DOCUMENTS

| | | | |
|---|---|---|---|
| 2010/0276281 | A1 | 11/2010 | Sandoval et al. |
| 2013/0153435 | A1 | 6/2013 | Sandoval |
| 2015/0218721 | A1 | 8/2015 | Jickling |

FOREIGN PATENT DOCUMENTS

| | | | |
|---|---|---|---|
| CN | 201686759 | U | 12/2010 |
| CN | 102296323 | A | 12/2011 |
| DE | 4241433 | A1 | 12/1992 |
| GB | 1169119 | | 10/1969 |
| WO | 03/062497 | A1 | 7/2003 |
| WO | 2009026678 | A1 | 3/2009 |

OTHER PUBLICATIONS

Notification of Transmittal of International Preliminary Report on Patentability received in corresponding application No. PCT/AU2013/001109, dated Jan. 27, 2015, 20 pages.

EP Search Report in counterpart EP 13.8420575, dated Mar. 21, 2016, 10-pgs.

English Translation of German patent DE4241433.

CATHODE AND METHOD OF MANUFACTURING

CROSS-REFERENCE TO RELATED APPLICATIONS

This is a divisional of U.S. application Ser. No. 14/431,569, filed 26 Mar. 2015, which is a 371 of International Appl. PCT/AU2013/001109, filed 26 Sep. 2013 claiming the benefit of Australian Appl. AU 2012904201, filed 26 Sep. 2012, which are incorporated herein by reference in their entirety and to which priority is claimed.

FIELD OF THE INVENTION

This invention is concerned with an electrode for electrolytic processes. The invention is concerned particularly, although not exclusively, with a cathode for an electrolysis process.

BACKGROUND OF THE INVENTION

Cathodes for electrolytic processes consist of a conducting bar and a plate of stainless steel or titanium placed in an electrolytic solution hanging from the conducting bar.

A problem with existing cathodes is that the conducting bar made of copper (which is a highly conductive metal) is welded to the stainless steel or titanium plate. The problem is that such a weld is difficult to produce and has bad resistance to acid mist which is produced, potentially resulting in the weld being quickly corroded and the plate becoming detached.

A problem with replacing the copper with a different metal is that there would be a significant voltage drop, this, multiplied by the number of electrodes in use and the high currents increases the operating costs substantially. One way around this is to coat a stainless steel conducting bar in copper, however, the copper coating separates from the stainless steel after a while due to the corrosion produced by the acid mist of the electrolytic operation, leading to a larger voltage drop.

Another prior art solution is to weld the stainless steel to the copper in a three part process where the first zone is formed of a copper-nickel alloy, an intermediate zone of mostly a nickel alloy and a second zone of stainless steel-nickel. This results in a satisfactory solution but requires a special welding process using nickel electrodes.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

OBJECT OF THE INVENTION

It is an object of the invention to overcome or at least alleviate one or more of the above problems and/or provide the consumer with a useful or commercial choice.

Other preferred objects of the present invention will become apparent from the following description.

SUMMARY OF THE INVENTION

In one form, although it need not be the only or indeed the broadest form, the invention resides in an electrode for electrolytic processes, the electrode comprising:

a conducting bar; and a plate attached to the conducting bar;

wherein the conducting bar has a conducting member attached thereto to increase the conductivity of the conducting bar.

Preferably, the electrode is a cathode. More preferably, the cathode can be used for electrolytic processes of copper production.

Preferably, the electrolytic processes are electrolytic processes of copper production. For example, copper electro refining or electro winning.

Preferably, the conducting bar is made of stainless steel. Alternatively, the conducting bar may be made from another suitable metal or alloy, such as titanium. It will be appreciated that the conducting bar may also be referred to as a hanger bar. Preferably the conducting member is attached to the conducting bar by welding. The conducting bar preferably has an inside surface. Preferably the conducting bar is hollow. More preferably the conducting bar has a tubular shape that is made by roll forming.

Roll forming is typically a continuous bending operation in which a long strip of sheet metal is passed through sets of rolls mounted on consecutive stands, each set performing only an incremental part of the bend, until the desired cross-section profile is obtained. Design of the rolls used in the roll forming operation typically starts with a flower formation, which is the sequence of profile cross-sections, one profile for each stand of rolls.

Preferably the conducting member is made of copper or a copper alloy. Alternatively, the conducting member may be made from another suitable metal or alloy having low resistivity. Typically the conducting member is welded to an inside surface of the conducting bar. Preferably the conducting member is welded to an inside surface of the conducting bar before the conducting bar is formed. For example, the conducting member is welded to a sheet or plate which is then roll formed into a conducting bar.

Preferably the plate is made from stainless steel. Alternatively, the plate may be made from another suitable metal or alloy, such as titanium.

Preferably the conducting bar is made from the same material as the plate. More preferably the conducting bar and plate are made of stainless steel. Typically the plate is welded to the conducting bar. Alternatively, the plate may be integrally formed with the conducting bar.

In one embodiment, the conducting bar may have a first and second portion substantially in axial alignment, a third portion axially offset from the first and second portion, a fourth portion disposed between the first and third portion and a fifth portion disposed between second and the third portion. Typically the plate is attached to the third portion. Preferably the axis of the third portion is below the level of the axis of the first and second portion. A benefit of this is that more of the plate can be in contact with an electrolyte solution. Preferably the conducting bar is roll formed into such a shape.

In another form, the invention resides in a method of manufacturing an electrode, the method including the steps of:

attaching a conducting member to an inside surface of a conducting bar; and attaching a plate to the conducting bar.

Preferably the step of attaching the conducting member to an inside surface of the conducting bar involves welding the conducting member to the conducting bar.

Preferably the step of attaching the plate to the conducting bar involves welding the plate to the conducting bar.

Preferably the method includes the step of forming the conducting bar into a hollow shape and/or a tubular shape. Preferably, the step of forming the conducting bar into a hollow shape and/or a tubular shape involves roll forming the conducting bar.

Preferably the method includes the step of forming the conducting bar such that a first and second portion are substantially in axial alignment, a third portion is axially offset from the first and second portion, a fourth portion is disposed between the first and third portion and a fifth portion is disposed between second and the third portion. Preferably, the step of forming the conducting bar into such a configuration involves roll forming the conducting bar. More preferably the method includes the step of forming the conducting bar such that a first and second portion are substantially in axial alignment, a third inclined portion and fourth inclined portion are disposed between the first and second portions, wherein the axes of the third inclined portion and fourth inclined portion are angled relative to the axes of the first and second portions. Preferably the third inclined portion and the fourth inclined portion form an obtuse angle. Alternatively the third inclined portion and the fourth inclined portion form a right angle or an acute angle. Preferably the third inclined portion is adjacent to the fourth inclined portion.

In a further form, the invention resides in an electrode for electrolytic processes, the electrode comprising:

a conducting bar; and a plate attached to the conducting bar;

wherein at least part of the conducting bar dips below an upper edge of the plate.

Preferably at least a top part of the conducting bar dips below an upper edge of the plate. Preferably, the conducting bar has a first and second portion substantially in axial alignment, a third inclined portion and fourth inclined portion disposed between the first and second portions, wherein the axes of the third inclined portion and fourth inclined portion are angled relative to the axes of the first and second portions. Preferably the third inclined portion and the fourth inclined portion form an obtuse angle. Alternatively the third inclined portion and the fourth inclined portion form a right angle or an acute angle. Preferably the third inclined portion is adjacent to the fourth inclined portion. Preferably the third inclined portion and the fourth inclined portion are inclined inwardly relative to an upper edge of the plate.

Preferably the plate comprises at least one cut-out. Preferably the at least one cut-out is located between a plane defined by the upper edge of the plate and a plane defined by the lowest part of the conducting bar.

Preferably the conducting bar is a conducting bar as disclosed in this specification. Alternatively, the conducting bar may be made of copper and/or a copper alloy.

In another form, the invention resides in a hollow conducting bar for an electrode having:

a conducting member attached to an inside surface of the conducting bar.

Preferably, the conducting bar is made of stainless steel. Alternatively, the conducting bar may be made from another suitable metal or alloy, such as titanium. Preferably the conducting member is attached to the conducting bar by welding.

Preferably the conducting member is made of copper or a copper alloy. Alternatively, the conducting member may be made from another suitable metal or alloy having low resistivity. Preferably the conducting member is welded to an inside surface of the conducting bar before the conducting bar is formed. For example, the conducting member is welded to a sheet or plate which is then roll formed into a conducting bar.

Preferably the conducting bar has a first and second portion substantially in axial alignment, a third portion axially offset from the first and second portion, a fourth portion disposed between the first and third portion and a fifth portion disposed between second and the third portion.

More preferably, the conducting bar has a first and second portion substantially in axial alignment, a third inclined portion and fourth inclined portion disposed between the first and second portions, wherein the axes of the third inclined portion and fourth inclined portion are angled relative to the axes of the first and second portions. Preferably the third inclined portion and the fourth inclined portion form an obtuse angle. Alternatively the third inclined portion and the fourth inclined portion form a right angle or an acute angle. Preferably the third inclined portion is adjacent to the fourth inclined portion.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, wherein.

DETAILED DESCRIPTION OF THE DRAWINGS

Figure 1:
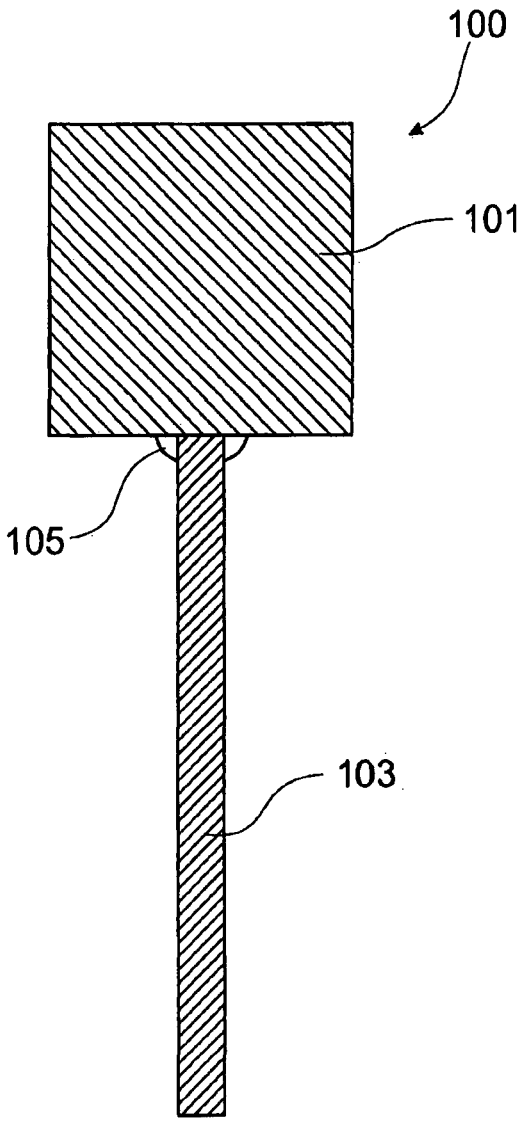
(Prior Art) FIG. 1
FIG. 1 shows a section of a prior art cathode.

FIG. 1 shows a prior art cathode 100 having a copper conducting bar 101 and a stainless steel plate 103. The stainless steel plate 103 is welded to the conducting bar 101 by welds 105. A problem with the stainless steel/copper welds 105 is that they are susceptible to corrosion and do not provide welds of high structural strength.

Figure 2:
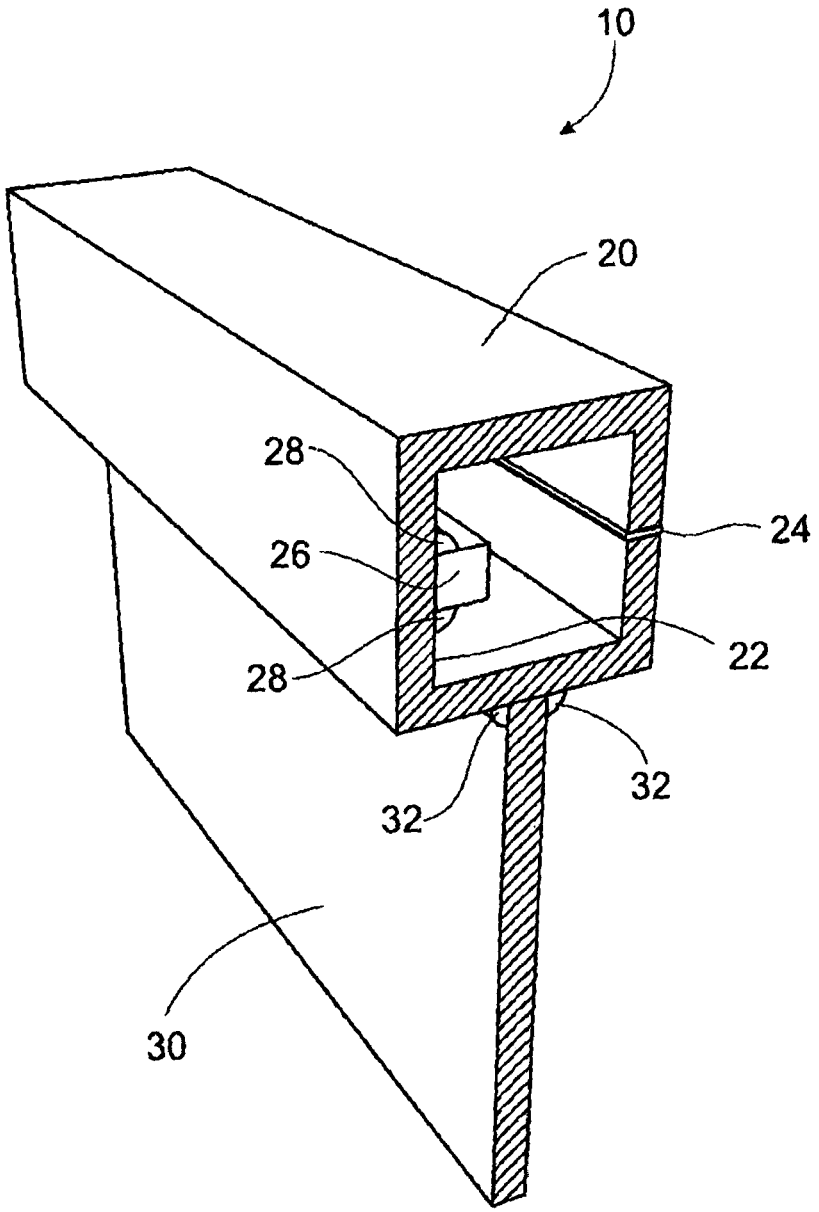
FIG. 2 shows perspective schematic view according to an embodiment of the invention.

With reference to FIG. 2, there is shown an electrode in the form of a cathode 10. The cathode 10 comprises a conducting bar 20 attached to a plate 30 by welds 32. A conducting member 26 is attached to the conducting bar 20 by welds 28.

The conducting bar 20 and the plate 30 are made of stainless steel and as such the welds 32 are stainless steel welds of high structural strength having resistance to corrosion. The conducting bar 20 is hollow, with an inside surface 22. The conducting bar 20 is welded by a weld 24 to provide a tube shaped conducting bar 20.

The conducting member 26 is made of copper and the welds 28 are not required to be as strong as the welds 32, as there is minimal structural load placed on welds 28.

The welds 28 are primarily for conductive purposes such that the conductivity of the stainless steel conducting bar 20 is increased by the copper conducting member 26. A benefit of having the conductive member 26 welded to an inside surface 22 of the conducting bar 20 is that the conductive member 26 and the welds 28 are less susceptible to corrosion. A benefit of welding the conductive member 26 to the conductive bar 20 is that the conductive member 26 is not required to provide structural strength to the conductive bar 20, as such, less copper material can be used, resulting in reduced costs.

Figure 3:
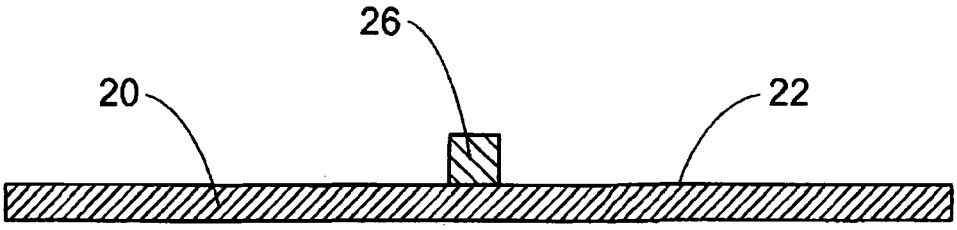
FIG. 3 shows a schematic cross sectional view of a conducting bar and a conducting member according to an embodiment of the invention.
Figure 4:
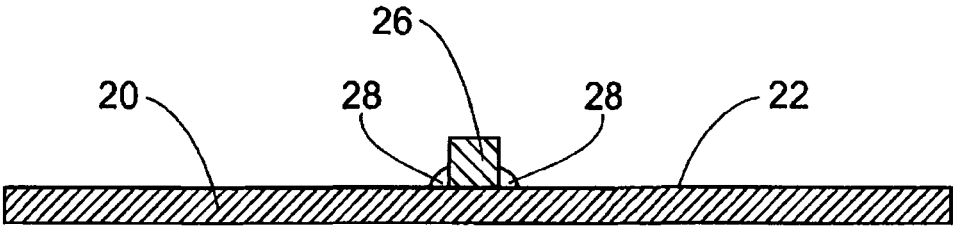
FIG. 4 shows a schematic cross sectional view of the conducting bar and a conducting member of FIG. 3 welded together.
Figure 5:
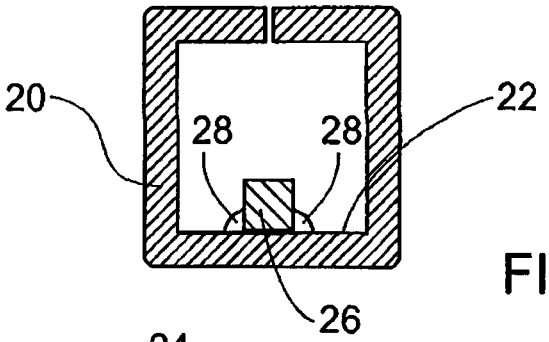
FIG. 5 shows a schematic cross sectional view of the conducting bar of FIG. 4 formed into a hollow shape.
Figure 6:
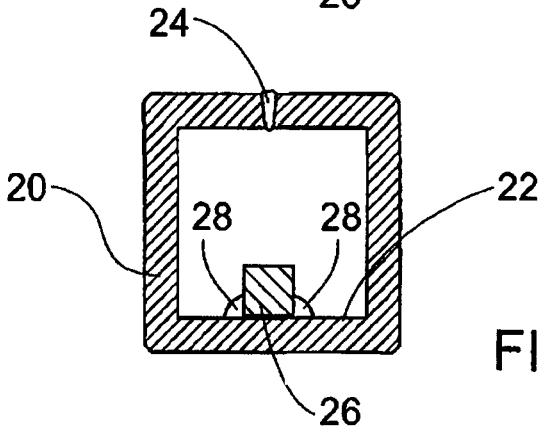
FIG. 6 shows a schematic cross sectional view of the conducting bar of FIG. 5 welded.
Figure 7:
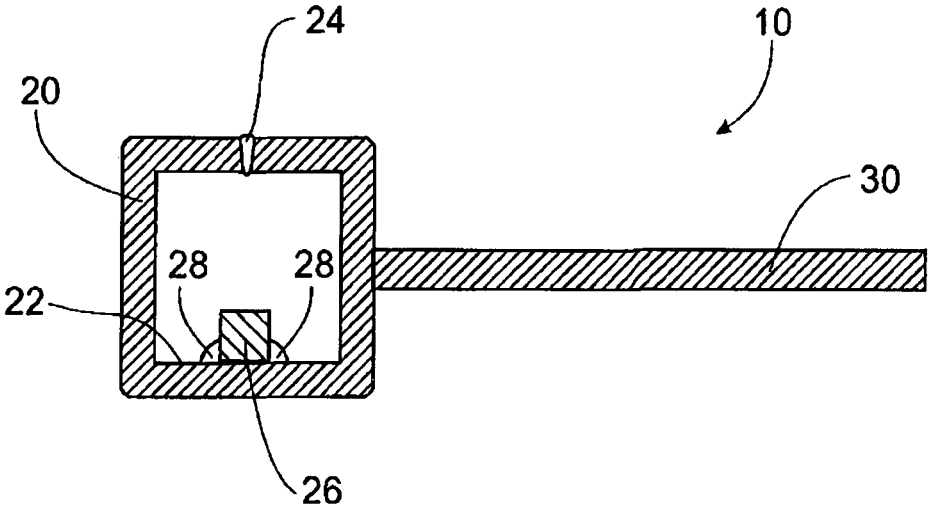
FIG. 7 shows a schematic cross sectional view of the conducting bar of FIG. 6 and a plate.
Figure 8:
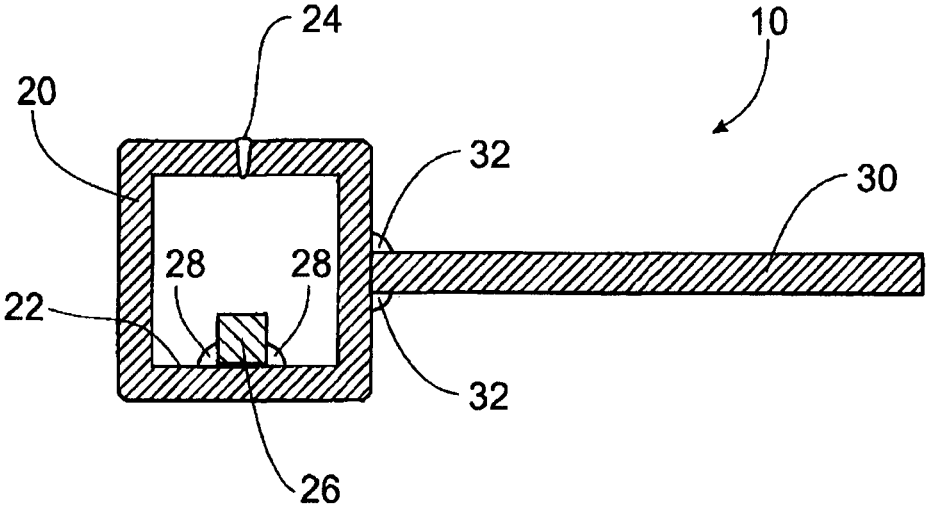
FIG. 8 shows a schematic cross sectional view of the conducting bar and the plate of FIG. 7 welded together.

With reference to FIGS. 3, 4, 5, 6, 7 and 8, there is shown a cathode 10 during various stages of production. In FIG. 3, the conducting member 26 is placed on the inside surface 22 (i.e. this will become the inside surface) of conducting bar 20 (i.e. this plate or sheet material will become the conducting bar). In FIG. 4, the conducting member 26 is attached to the conducting bar 20 by welds 28. In FIG. 5, the conducting bar 20 is roll formed to provide a hollow shape. In FIG. 6, the conducting bar 20 is sealed along its length by weld 24. In FIG. 7, the plate 30 is positioned adjacent to the conducting bar 20. In FIG. 8, the plate 30 is attached to the conducting bar by welds 32.

Figure 9:
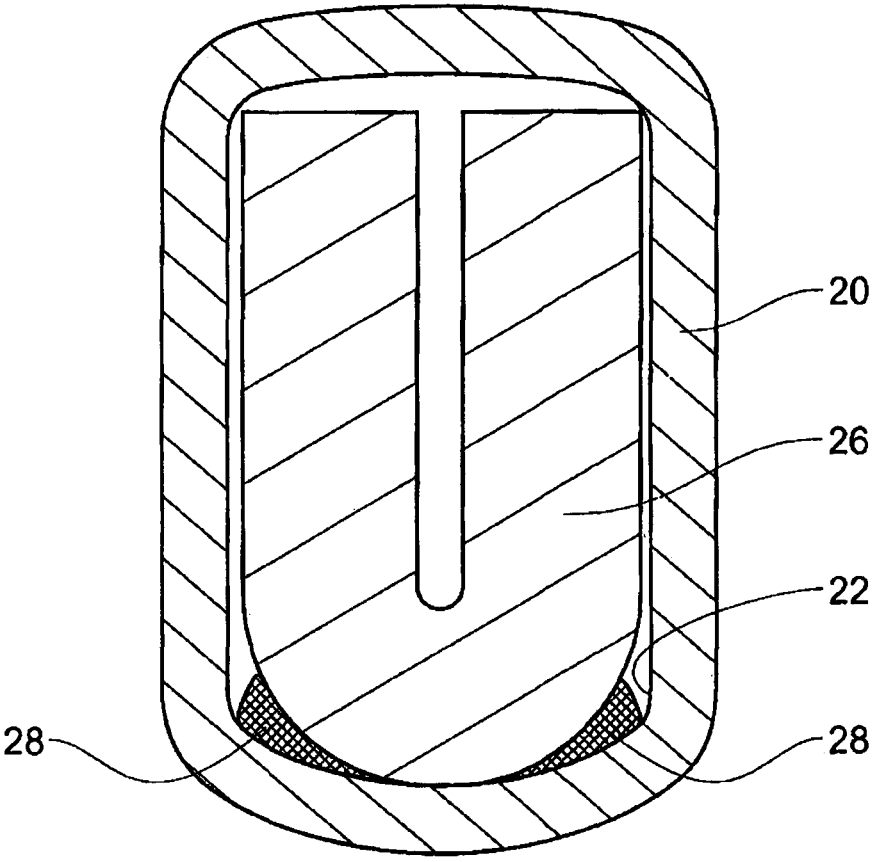
FIG. 9 shows a schematic cross sectional view of a conducting bar according to an embodiment of the invention.

With reference to FIG. 9, there is shown a cross sectional view of a conducting bar 20 according to an embodiment of the present invention. The conducting bar 20 is made of stainless steel and has a conducting member 26 made of copper attached to an inside surface 22 of the conducting bar 20 by welds 28. As can be seen from FIG. 9, the conducting member 26 has a CU' shape cross section. A benefit of this is that the conducting member 26 can be made by bending or roll forming a sheet or plate material.

Figure 10:
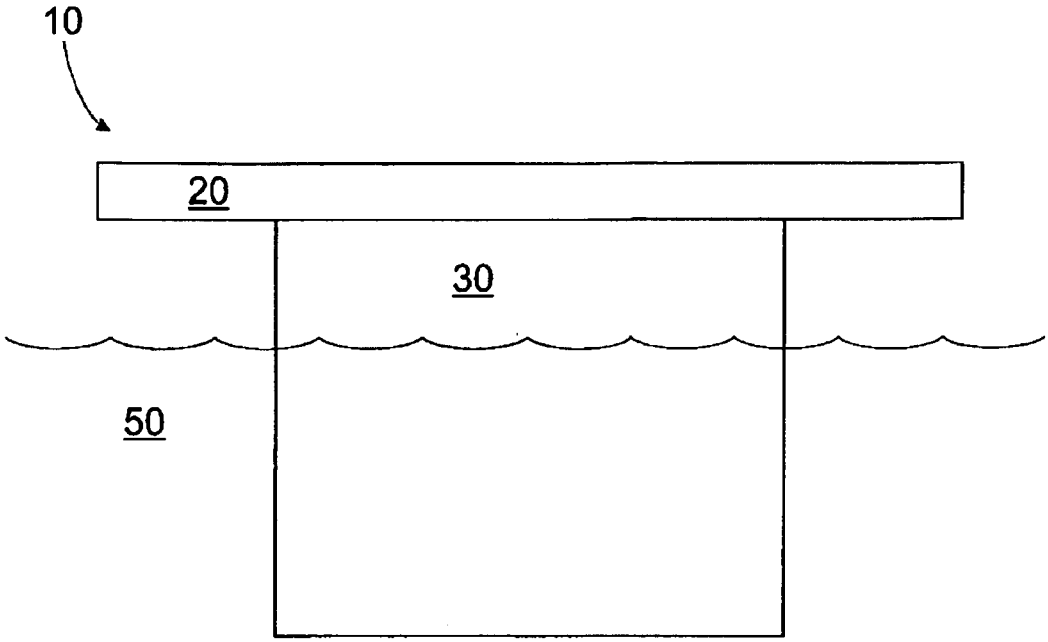
FIG. 10 shows a schematic view of an electrode according to an embodiment of the invention.

With reference to FIG. 10, there is shown a cathode 10 according to the present invention with a "straight" shaped conducting bar 20 and a plate 30 which is placed in electrolyte solution 50.

Figure 11:
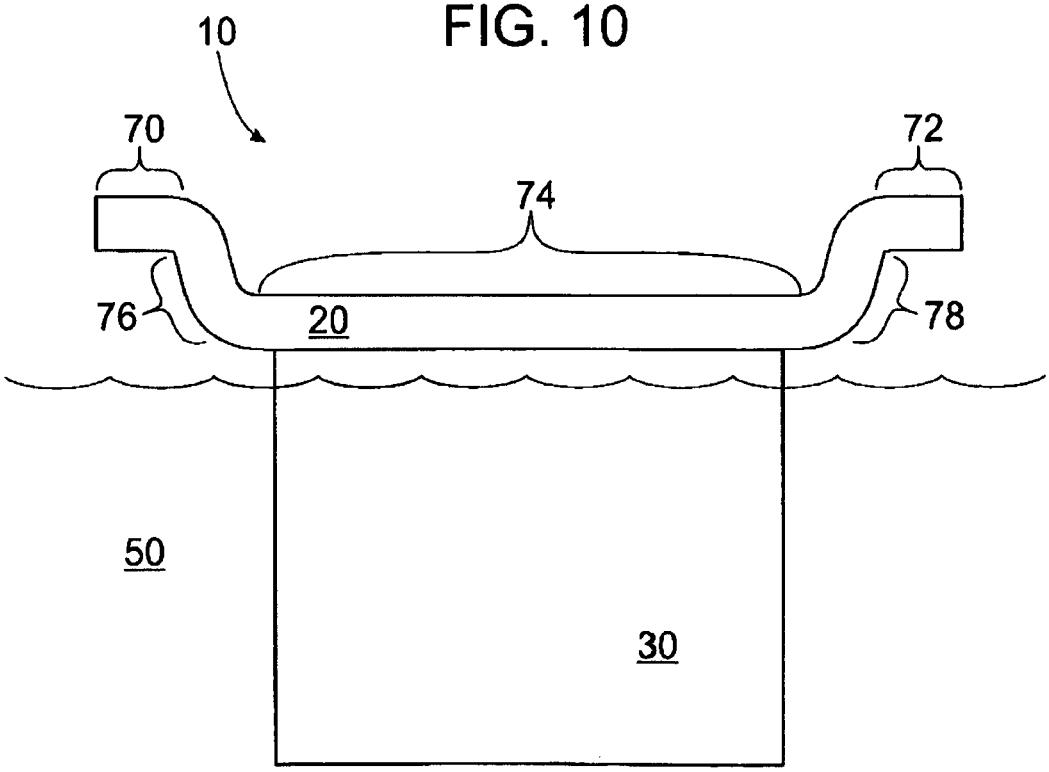
FIG. 11 shows a schematic view of an electrode according to an embodiment of the invention.

With reference to FIG. 11, there is shown a cathode 10 according to the present invention with conducting bar 20 having a first portion 70 and a second portion 72 substantially in axial alignment, a third portion 74 is axially offset from the first portion 70 and second portion 72, a fourth portion 76 is disposed between the first portion 70 and third portion 74 and a fifth portion 78 is disposed between second portion 72 and the third portion 74. A plate 30 is attached to the third portion 74 of the conducting bar 20. The plate 30 is placed in electrolyte solution 50.

As can be seen by comparing FIGS. 10 and 11, the cathode 10 in FIG. 11 has more of the plate 30 in the electrolytic solution, this results in a lower voltage drop between the conducting bar 20 and the part of the plate 30 which is in the electrolytic solution 50.

Figure 12:
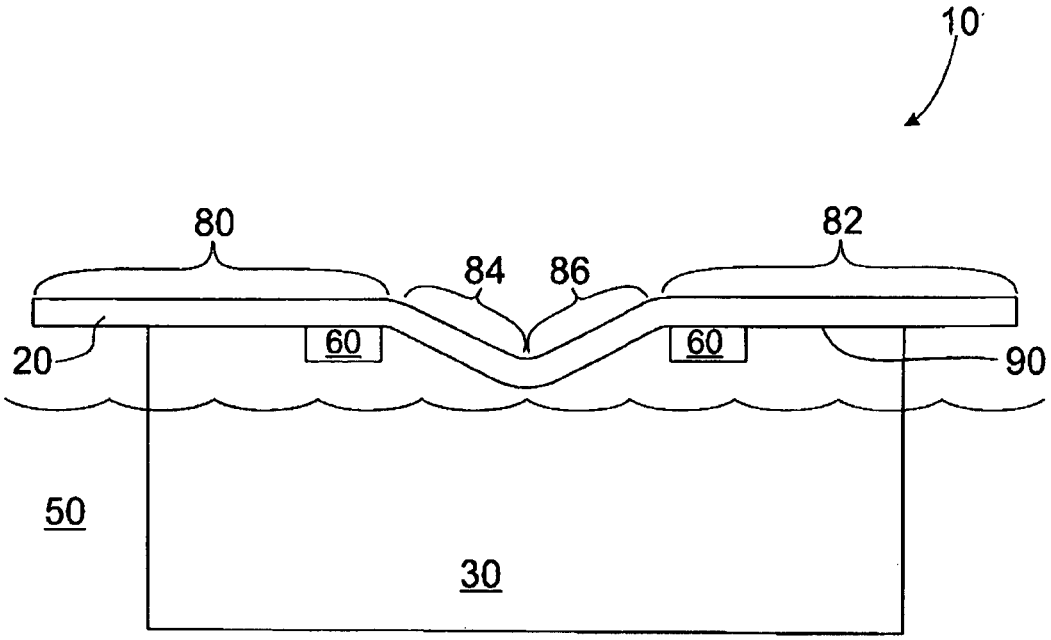
FIG. 12 shows a schematic view of an electrode according to an embodiment of the invention.

With reference to FIG. 12, there is shown a cathode 10 according to the present invention with a conducting bar 20 having a first portion 80 and second portion 82 substantially in axial alignment, a third inclined portion 84 and a fourth inclined portion 86 are disposed between the first portion 80 and the second portion 82. The third inclined portion 84 and the fourth inclined portion 86 are angled relative to the first portion 80 and the second portion 82. The plate 30 is attached to the conducting bar 20 and is placed in electrolyte solution 50. As can be seen from FIG. 12, part of the third inclined portion 84 and the fourth inclined portion 86 of conducting bar 20 dip below an upper edge 90 of the plate 30. Cut-outs 60 are located adjacent to the conducting bar 20 and an upper edge 90 of the plate 30.

Throughout the specification the aim has been to describe the invention without limiting the invention to any one embodiment or specific collection of features. Persons skilled in the relevant art may realize variations from the specific embodiments that will nonetheless fall within the scope of the invention. For example, individual features from one embodiment may be combined with another embodiment.

It will be appreciated that various other changes and modifications may be made to the embodiment described without departing from the spirit and scope of the invention.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

What is claimed is:

1. A method of manufacturing a cathode for electrolytic process, the method including the steps of:

attaching a conducting member to a side of a planar plate by welding the conducting member to the side of the planar plate;

roll forming a hollow conducting bar from the planar plate, wherein the side of the planar plate to which the conducting member is attached defines an inside surface of the hollow of the conducting bar;

attaching a plate to the conducting bar, wherein the step of roll forming the hollow conducting bar includes:

forming a first and second portion of the conducting bar substantially in axial alignment; and forming a third inclined portion of the conducting bar and a fourth inclined portion of the conducting bar disposed between the first and second portions, wherein the axes of the third inclined portion and fourth inclined portion are angled relative to the axes of the first and second portions.

2. The method of claim 1, wherein the cathode is used for electrolytic processes of copper production.

3. The method of claim 1, wherein the hollow conducting bar is made of stainless steel.

4. The method of claim 1, wherein the third inclined portion and the fourth inclined portion form an obtuse angle.

5. The method of claim 1, wherein the third inclined portion and the fourth inclined portion form a right angle or an acute angle.

6. A method of manufacturing a hollow conducting bar, the method including the steps of:

attaching a conducting member to a side of a planar plate by welding the conducting member to the side of the planar plate; and roll forming the hollow conducting bar from the planar plate, wherein the side of the planar plate to which the conducting member is attached defines an inside surface of the hollow of the conducting bar, wherein the step of roll forming the hollow conducting bar includes:

forming a first and second portion of the conducting bar substantially in axial alignment; and forming a third inclined portion of the conducting bar and a fourth inclined portion of the conducting bar disposed between the first and second portions, wherein the axes of the third inclined portion and fourth inclined portion are angled relative to the axes of the first and second portions.

7. The method of claim 6, wherein the conducting bar is used for electrolytic processes of copper production.

* * * * *